United States Patent [19]

Bull

[11] Patent Number: 4,809,375

[45] Date of Patent: Mar. 7, 1989

[54] MATTRESS WITH REMOVABLE MATTRESS COVER

[75] Inventor: Barry J. Bull, Phoenix, Ariz.

[73] Assignee: B & E Enterprises, Phoenix, Ariz.

[21] Appl. No.: 855,138

[22] Filed: Apr. 23, 1986

[51] Int. Cl.[4] ..... A47C 27/05; A47C 23/04

[52] U.S. Cl. ..... 5/465; 5/470; 5/473; 5/448

[58] Field of Search ..... 5/470, 471, 464, 465, 5/448, 473, 474

[56] References Cited

U.S. PATENT DOCUMENTS

| | | | |
|---|---|---|---|
| 319,903 | 5/1906 | Maussner | 5/484 |
| 1,375,061 | 4/1921 | Nyhus | 5/470 |
| 1,892,913 | 1/1933 | Timm | 5/470 |
| 2,154,910 | 4/1939 | Magaril | 5/470 |
| 2,425,728 | 8/1947 | Cobb | 5/470 |
| 3,027,573 | 4/1962 | Bell | 5/470 |
| 3,287,749 | 11/1966 | Marsico | 5/470 |
| 3,493,980 | 2/1970 | Haller | 5/470 |
| 3,581,322 | 6/1971 | Marsico | 5/470 |
| 3,950,800 | 4/1976 | Garshfield | 5/470 |
| 4,388,738 | 6/1983 | Wagner | 5/470 |
| 4,424,600 | 1/1984 | Callaway | 5/470 |
| 4,449,261 | 5/1984 | Magnusson | 5/470 |

FOREIGN PATENT DOCUMENTS

| | | | |
|---|---|---|---|
| 3223770 | 1/1983 | Fed. Rep. of Germany | 5/470 |

*Primary Examiner*—Alexander Grosz
*Attorney, Agent, or Firm*—Harry M. Weiss

[57] ABSTRACT

The present invention provides an improved mattress arrangement wherein the outer portion of the mattress body itself includes a deck covering which may be a conventional fabric or sheet of waterproof material for preventing any moisture from passing therethrough and into the interior of the mattress. The removable mattress cover is removably secured to the deck cover about the outer peripheral edges thereof, as by zippers or the like, so that the removable mattress cover can be removed for laundering, washing, cleaning, or replacement. Different and distinct removable mattress covers or pads can be substituted for one another and changed with the season or desires or needs of the individual occupying the bed. Furthermore, the construction of the removal mattress covers may include upper and lower surfaces of natural or synthetic material with intermediate layers of foam materials or fill material and various single layer members or materials, such as sheepskin, or the like, can also be used. Intermediate layers can be disposed between the lower surface of the removable mattress cover and the upper surface of the deck cover, including such members as waterproof sheets and/or absorbent foam pads.

13 Claims, 2 Drawing Sheets

MATTRESS WITH REMOVABLE MATTRESS COVER

BACKGROUND OF THE INVENTION

1. Field of the Invention

The present invention relates generally to a removable mattress cover or mattress pad which forms an integral portion of the mattress, and more particularly to a removable mattress cover for forming the top sleeping surface of the mattress and possibly for forming both the top and bottom exterior surfaces of the mattress, wherein the removable mattress covers can be selectively removed for washing, cleaning or laundering so that even badly soiled mattresses can be cleaned, rather than replaced, and such that a second mattress cover can be removably secured to the top of the mattress when the first mattress cover is removed for cleaning and the like.

2. Description of the Prior Art

The prior art teaches several different types of independent or non-integral mattress covers. Typical of such mattress covers is the generally rectangular fabric bag which can be pulled over the mattress itself to provide some minimal degree of protection from dirt and the like. When dirty, the fabric bag can be removed and laundered, but such covers provide little or no real protection, and most of the types of dirt and grime, and particularly moisture and materials which cause stains, pass directly through the fabric bags and permanently stain or otherwise soil the top of the mattress itself. Such mattresses, once stained or badly soiled, must be replaced, since the mattress itself cannot be laundered or cleaned in any practical, economical manner.

Other types of mattress covering systems of the prior art include covering a mattress with a vinyl pad or sheet of waterproof material for preventing liquid or moisture from passing into the mattress so as to prevent permanent stains or badly soiled mattress portions. The inadequacy of the waterproof sheets lies in the fact that they are extremely uncomfortable, since they tend to bunch up in wrinkles, folds, creases and the like which are extremely uncomfortable to the person using the bed and which can cause bed sores and the like. Furthermore, such waterproof sheets often slide off of the bed or off of a portion of the mattress so that the exposed portion becomes badly soiled, stained or torn, as does the fallen portion thereby providing little real protection for the mattress itself.

The addition of foam pads or the like over the top of the deck cover or over the waterproof sheet adds little if no real improvement over the prior art systems. The foam rubber pad itself will bunch up, wrinkle, fold and/or move independently of the waterproof sheet, which will also fold, crease, and bend to cause undue wear and discomfort to the person using the bed. Furthermore, the pads have to be cleaned often even though they are normally covered with a sheet or sheet blanket upon which the person actually lays, since sheets or sheet blankets are relatively thin fabric materials which offer substantially no protection from dirt and grime, and since they do not inhibit the passage of liquid or moisture therethrough.

Although a mattress having an extremely soiled or stained top surface can be flipped on time and utilized until the turned side becomes soiled or stained, the mattress must, nonetheless, be replaced, rather than cleaned, and this is particularly important in hotels, motels, dormitories, barracks, some hospitals, some nursing homes, institutions of various natures, furnished apartments, and any similar application having a relatively high turn-over of persons utilizing the mattresses. The prior art systems of mattress covers are totally separate and dependent from the mattress itself, not forming an integral sleeping surface, and lend little if any real protection thereto.

The present invention solves substantially all of the problems of the prior art while avoiding its shortcomings by providing a removable mattress cover for at least the top surface, and preferably for both the top and bottom surfaces of the mattress, and wherein the mattress covers normally function as integral portions of the mattress itself, which can be removed for washing, repairing, laundering, or cleaning, thereby greatly prolonging the useful life of the mattress.

BRIEF SUMMARY OF THE INVENTION

It is an object of the present invention to provide a removable mattress cover which normally forms an integral portion of the mattress itself, but which is selectively removable for washing, laundering, or cleaning the mattress cover thereby greatly prolonging the useful life cycle of the mattress.

It is another object of the present invention to provide a removable cover for a mattress which can be snugly secured over the top deck of the mattress for providing a comfortable nd wrinkle-free surface.

It is still another object of the present invention to provide the top surface of a mattress with a deck cover means for substantially enclosing the interior portion of the mattress, a removable mattress cover which is normally an integral portion of the mattress and which forms the sleeping surface therefor, and fastener means for removably attaching and detaching the mattress cover from the deck cover for enabling the mattress cover to be removed for laundering and the like.

It is yet another object of the present invention to provide a removable mattress cover which may be selectively interchangeable with another similarly-constructed removable mattress cover.

It is a further object of the present invention to provide an improved mattress including a sheet of waterproof material means serving as the top deck cover and a removable mattress cover which is removably secured thereto.

It is still a further object of the present invention to provide a removable mattress pad on both the top and bottom sleeping surfaces of the mattress.

It is yet a further object of the present invention to provide removable top and bottom mattress pads which are interchangeable with one another.

It is another object of the present invention to provide a removable sheepskin mattress cover.

It is a further object of the present invention to provide a removable mattress cover which can be selectively connected to and removed from the deck cover of a mattress.

It is yet a further object of the present invention to provide a removable mattress cover which can be selectively connected to and separated from a deck cover including a waterproof material.

It is still another object of the present invention to provide an improved mattress having a removable mattress cover, a deck cover, and one or more intermediate layers therebetween.

It is yet another object of the present invention to provide a mattress cover which may be selectively fastened to and removed from a deck cover wherein the deck cover may be a sheet of waterproof material fixedly secured to the top of the mattress and wherein an intermediate layer may include a foam rubber absorbent pad for changing the "feel", "firmness", and/or "texture" of the mattress.

It is yet another object of this invention to provide a fastener means for operatively connecting and unconnecting the mattress cover from the deck cover so as to tightly secure said mattress cover over the deck cover for preventing discomfort-causing wrinkles, bends, folds, creases, and the like from forming in the mattress cover.

It is still a further object of the present invention to provide a deck cover which is fixedly secured tightly to the top surface of the mattress to prevent wrinkles, creases, folds, and the like; a removable mattress cover; and fastening means for selectively removably connecting and removably disconnecting the mattress cover to the deck cover for enabling the mattress cover to be removed for laundering interchanged and the like.

It is yet another object of the present invention to provide a removable mattress cover-deck cover combination wherein the fastening means for removably connecting and unconnecting the removably mattress cover to the deck cover includes at least one zipper.

It is yet another object of this invention to provide an improved mattress and mattress pad or cover combination.

It is yet a further object of this invention to provide an improved mattress.

It is still another object of this invention to provide a removable mattress cover for a modified mattress wherein the modified cover becomes the integral sleeping surface of the mattress when selectively secured thereto and which can be removed for laundering replacement and the like.

It is yet a further object of this invention to provide a removable cover means for a substantially flat, cushion-like object which includes a deck covering over the cushion-like object and fastener means for removably coupling and uncoupling said removable cover means to said deck means so that said cover means normally forms an integral portion of the cushion-like object and can be removed for laundering and the like.

The present invention is directed to an improved mattress having a top surface, a bottom surface, and an interior housing means for resiliently supporting a person lying on the top surface. The improvement includes a deck cover means operatively and fixedly secured over at least the top and preferably over both the top and bottom surfaces of the mattress with the deck cover including either a fabric material means or a sheet of waterproof material means. The deck cover is fixedly secured to the top of the mattress, as by sewing or the like, and at least a removable top mattress cover or mattress pad is provided. Preferably both a top and a bottom mattress cover or pad are provided and they are interchangeable with one another. Fastening means are provided, including a first fastener portion or interlocking member and a second fastener portion or interlocking member, for removably attaching the mattress cover to the deck cover so as to enable the mattress cover to be removed for laundering, washing or cleaning and the like. The fastening means may be any conventional suitable fastening means such as zipper means, hook-and-loop fasteners means, snap-fastener means or the like.

When removably attached to the deck cover, the mattress cover forms the integral sleeping surface of the mattress itself, and when the top mattress cover is removed, another similarly constructed mattress cover, such as the removable bottom mattress cover, can be substituted therefore. When both the top and bottom of the mattress include removable mattress covers, they are interchangeable and can be substituted for one another as desired. Further, the top and bottom mattress covers may be different and distinct.

The first half of the fastening means is fixedly secured about the outer peripheral edge of the deck pad while a corresponding portion is fixedly secured about the peripheral outer edge of the removable mattress cover for snugly attaching said mattress cover firmly and tightly over the deck cover for preventing rinkles, creases, folds and the like therein, thereby preventing discomfort to the person lying on the sleeping surface of the mattress while enabling the mattress cover to stretch sufficiently to allow intermediate layers or inner panels, such as foam pads, pads of bulk fill material, absorbent pads, waterproof pads, and the like to be inserted or sandwiched therebetween.

The mattress covers include all launderable, cleanable or washable material means and the deck cover may be either a sheet or fabric material or a sheet of waterproof material such as vinyl plastic or the like. An intermediate layer or fill means may be provided between the top removable mattress cover and the top deck cover for insulation purposes, protection purposes, moisture absorbing purposes, or the like. The fill means may include any conventional synthetic foam means and/or any natural or synthetic fill means for changing the "feel", "texture", "firmness", "look", etc. of the mattress. The sleeping surface formed by the exterior surface of the removable mattress cover may include a material having an aesthetically pleasing appearance and a pleasant touch or "feel". The mattress cover may include any conventional natural fiber, synthetic fiber, real animal fur or synthetic animal fur. Furthermore, the material of the removable mattress cover may include any one of materials such as velvet, silk, satin, felt, real and synthetic fur, plastic material, or the like and or could include an old-fashioned quilted comforter or the like.

The invention would have particular usefulness in such places as hotels, motels, dormitories, barracks, hospitals, nursing homes, institutions, boarding schools, furnished apartment, and any similar facilities having a high turnover of persons utilizing the mattress.

While the deck cover is shown as a sheet of fabric material, a sheet of waterproof material can also be used. When fabric is used, an intermediate layer including a sheet of waterproof material and/or a foam material can be used between the deck cover and the removable mattress cover. When the deck cover is a sheet of waterproof material, an intermediate layer of foam means can be disposed between the deck cover and the removable mattress cover, as desired. The foam layer may include an absorbent material for absorbing and retaining any moisture or liquid passed through the removable mattress cover and blocked by the waterproof sheet and for spacially separating the mattress cover from the moisture retained by the waterproof sheet for at least partially protecting the person lying on the bed from the moisture retained by the resilient foam layer.

The invention may further provide an improved mattress or an improved removable mattress pad and mattress combination which includes a heating pad means sized to fit over the deck cover and fastening means for removably securing the heating pad to the deck cover for forming the heating pad as an integral portion of the mattress and providing increased heating efficiently by warming the bed from beneath the person lying thereon. Alternatively, the heating pad can be sized to fit over the deck cover and adapted to be removably disposed between the top deck cover and the top removable mattress cover for heating the bed more efficiently from beneath, rather than above, the person lying on the sleeping surface of the mattress cover.

The mattress covers may be different and distinct from one another, and any can be similarly constructed so as to be interchangeable with any other. Further, the mattress may be provided with both top and bottom removable mattress covers which normally form the integral top and bottom sleeping surface portions of the mattress itself, and either or both can be selectively removed. For example, the top removable mattress cover can be removed for laundering or cleaning, and the bottom mattress cover can be removed and replaced or substituted for the top mattress cover or the mattress can be flipped over so that the mattress can be used even while the original mattress cover portion is being laundered. Various innerpanels may be included between the deck cover and the removable mattress cover, and various means for sewing the portions of the flange, the outer side covering, the ribbon, and the zipper tape to one another can be used. The removable mattress covers can include a plurality of different and distinct materials, designs, patterns, colors, textures, insulative characteristics, weights, and the like for enabling said removable mattress cover to be changed with the seasons, to be changed depending upon the desires, likes, and dislikes of the person currently using the bed, i.e. such as utilizing one brightly decorated mattress cover with cartoon characters and the like for children and then substituting a removable interchangeable quilted comforter mattress cover for an elderly person who is the next occupant of the bed.

These and other objects and advantages of the present invention will be more fully understood from reading the detailed description of the preferred embodiment, the claims, and the drawings, which are briefly described hereinbelow.

DETAILED DESCRIPTION OF THE PREFERRED EMBODIMENT

Figures 1, 2, 3:
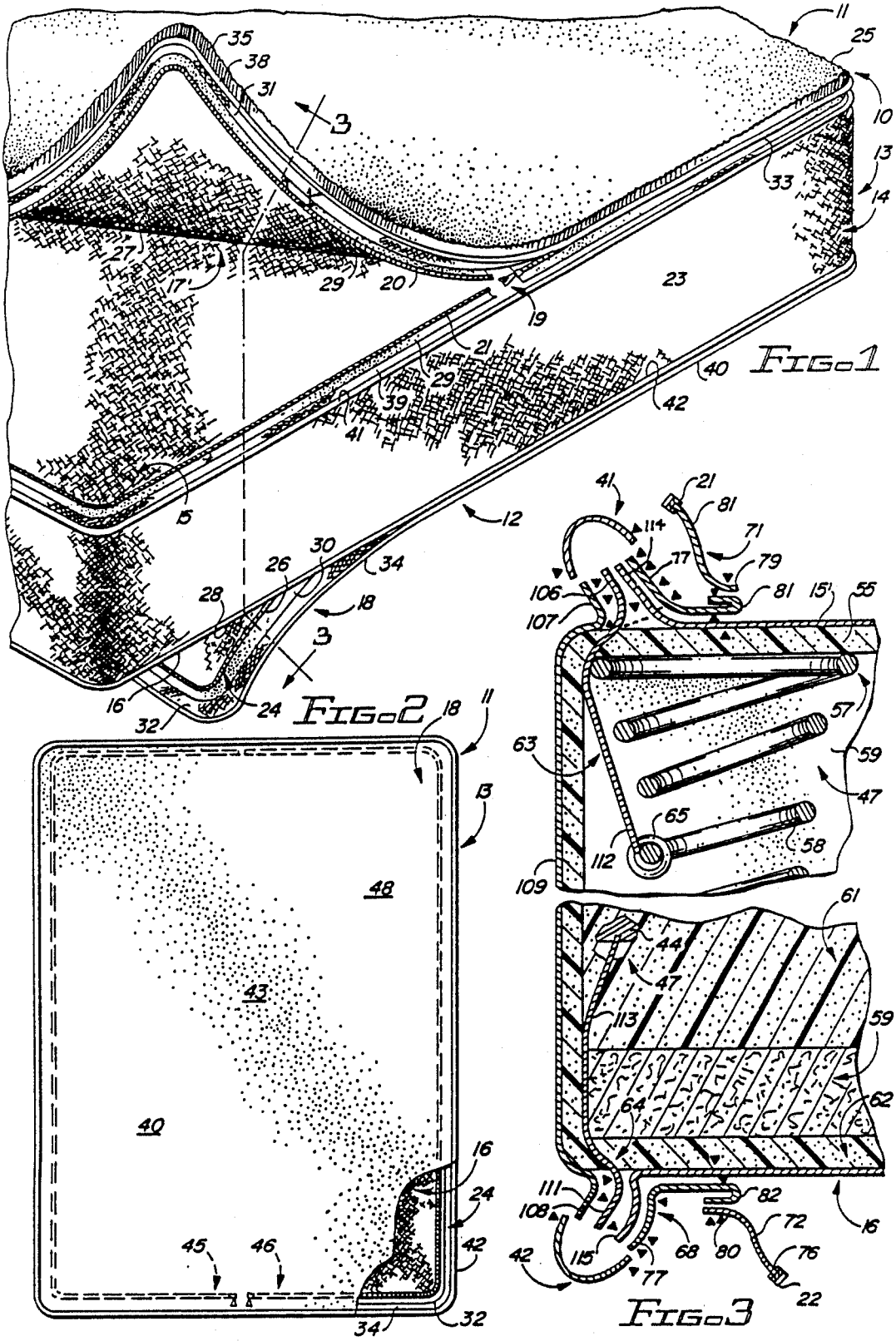
FIG. 1 presents a perspective view, partially broken away, of an improved mattress or mattress and mattress cover combination provided with the removable mattress covers of the present invention.
FIG. 2 is a bottom plan view, partially cut away, of the improved mattress of FIG. 1.
FIG. 3 is a sectional side view, partially exploded and exaggerated, to show the fastening means and attachment means therefore for removably connecting the top and bottom mattress covers to the top and bottom deck covers of the mattress.

FIG. 1 shows the improved mattress of mattress and pad combination 11 of the present invention. A mattress 13 is shown as having a top sleeping surface 10, a substantially identical bottom sleeping surface 12, and a continuous side panel or side surface 14 therearound. The top of the mattress 13 includes, in the preferred embodiment of the present invention, an innerpanel or deck cover 15 which closes the interior of the mattress 13 on the top while a corresponding innerpanel or deck panel 16 closes the interior of the mattress 13 from the bottom.

The combination mattress and pad or cover combination 11 of FIG. 1 is shown as including a removable top mattress pad or mattress cover 17' while the bottom of the mattress 13 includes a second lower or bottom removable mattress pad or mattress cover 18. Fastening means such as a conventional zipper 19 having a first zipper portion, first interlocking member, or zipper strip 20 and a second zipper portion, interlocking member, or zipper strip 21 is provided for removably securing or attaching the upper or top removable mattress cover 17' to the deck cover 15 while the lower portion includes a second fastening means or zipper 24 having one zipper portion 26 and a corresponding cooperating zipper portion 22 (not shown) for removably securing the bottom removable mattress pad 18 to the lower deck cover 16.

The first zipper portion 20 is fixedly attached, as by sewing or the like, to one edge of a ribbon 31 by a zipper strip 29. The outer peripheral edge portion of the zipper strip 29 and ribbon 31 are fixedly attached to one another, as by sewing or the like, and then overlayed with the outermost exterior layer, in the present embodiment a sheepskin material 25 having an exterior or outer wool-type nap surface 35 and a nap-carrying base layer 38. The exterior layer(s) of the mattress cover 17 is fixedly secured about its outer periphery, at the edge portion thereof, to the zipper strip 29-ribbon 31 combination with the outer distal edge portions of the sipper strip 29, the ribbon 39 and the outer edge portion of the base 38 of the sheepskin material 25 by a closing means or tape edge 33 and fixedly secured within the tape edge 33 as by sewing or the like. The top surface or nap 35 of the sheepskin outer layer 25 presents a wool upper sleeping surface 10 to the user of the mattress 13 which is both aesthetically appealing and pleasant in texture and "feel". Just as the top removable mattress cover 17' includes an exterior wool sleeping surface 35, it also includes an inner covering surface 27, and may be provided with a fill material or foam material therebetween, as hereinafter described.

Similarly, the bottom removable mattress cover 18 is removably secured to the lower deck cover 6 by a zipper 24 which includes a first zipper portion 26 and a corresponding second zipper portion 22 (See FIG. 3). The first zipper portion 26 is attached to a zipper strip 30 which is fixedly attached, as by sewing or the like, to a ribbon 32. The ribbon 32-zipper strip 30 edge combination is then fixedly secured about the outer periphery of the removable mattress cover 18 which is the outer distal edge portion being fixedly secured within an edge tape 34, as by sewing or the like. The interior-facing surface of the lower removable mattress cover 18 of the present invention is shown as including a fabric or material 28 while the outer or exterior sleeping surface 12 includes a material 40. Typically, the material 40 and the material 23 of the sides 14 of the mattress 13 are manufactured from identical fabrics or material. Furthermore, a corresponding second zipper portion 22, not shown in FIG. 1, is fixedly secured to the outer peripheral edge portion of the lower deck panel 16 such that the first and second zipper portions 22, 26 cooperatively interlock to zip or unzip or to attach or remove the bottom mattress pad 18 forming the bottom sleeping surface 12 of the mattress 13 from the bottom deck cover 16. Just as the outer peripheral edges of the layers of material including the top deck 15, zipper strip 29 and ribbon 39 are closed with the tape 41 about the outer distal peripheral edge of the mattress 13, the lower edge of the mattress 13 is closed by a tape 42 fixedly secured about the distal peripheral edge portion of the innerpanel 16, the mattress side covering 23, a ribbon portion (not shown), and a flange portion (not shown).

FIG. 2 represents a bottom plan view of the improved mattress 13-removable mattress pad 18 combination 11 of the present invention with the lower removable mattress cover 18 removably secured or attached to the lower deck cover 16 of the mattress 13. The mattress 13 is shown as having an outer peripheral edge portion bound or closed by the tape strip 42, and it illustrates that the lower zipper fastener 24 actually includes first and second separate and distinct zipper assemblies 45 and 46, each of which has one end portion terminating adjacent a corresponding end portion of the other to enable the two zippers 45 and 46 to be unzipped in opposite directions about the periphery of the removable mattress cover 18 and deck cover 16 for completely unzipping and removing the mattress cover 18, as desired.

The cut-away portions of the illustration of FIG. 2 show the outer peripheral edge portion of the removable mattress cover 18 as being terminated in the tape binding 34 while the outer peripheral edge portion of the mattress bottom, including the deck cover 16, ribbon 32, lower flange 64 (not shown) and the lower end portion of the side material 23 (not shown), as hereinafter described. Furthermore, the cut-away portion exposes the lower or bottom innerpanel or deck cover 16 which, in the preferred embodiment of FIG. 2, represents a waterproof sheet or panel of material which is impervious to the passage of liquids or moisture therethrough for preventing the passage of moisture or liquid through the mattress cover 18 into the mattress interior. The cut away portion further reveals a layer of foam or fill material 43 disposed or sandwiched between the outer exterior sleeping surface 12 of the removable mattress over 18 which includes a layer or sheet of exterior-facing material 40 while the opposite cut-away portion represents an inner or mattress-facing layer or sheet of material 48 such that the outer and inner layers 40, 48, respectively, sandwich in the fill means 43 therebetween.

In FIG. 3, a portion of the mattress 13 itself is shown together therewith the attachment means for removably attaching and unattaching or detaching the upper and lower removable mattress covers 17' and 18, respectively, which form an integral part (actually the sleeping surfaces) of the mattress 13, when attached, and will now be described in detail. FIG. 3 shows a sectional side view of the mattress assembly 11 of the present invention and includes a partial section taken longitudinally through the mattress 13 to show two different embodiments of mattress interiors, although it must be understood that the present invention finds use with substantially all known types of mattresses, regardless of their interior constructions. As previously described, the top surface of the matress 13 is bounded or closed by the upper deck cover 15' while the bottom surface is bound or closed by a lower deck cover 16. Positioned about the interior 47 of the mattress 13 is an upholstery portion 55 such as a foam sheet or pad which extends completely across the top, bottom and sides of the mattress 13 to totally enclose the interior 47 from the exterior bounded by the top and bottom deck covers 15' and 16 and the fabric-covered sides 14.

In one embodiment, the interior 47 of the mattress 13 is shown as including a plurality of spatially separated mattress springs 57 each of which includes an intermediate spring coil 58. The mattress is actually held together snugly by the flange 63 which has a lower end portion 112 fixedly secured or hog-ringed to the intermediate spring portion 58 by a loop or ring member 65 or by any suitable conventional fastening means. The opposite end portion 106 extends through the top peripheral edge of the mattress 13 so that it can be pulled snugly upwardly (or alternatively, pulled downward) and sewn or otherwise anchored, as hereinafter described. The interior 47 of the embodiment of FIG. 3 utilizing the springs 57 includes a distributed, layer, or multiple layers of various fill material 59 around and about the coils of the springs 57 for additional support and comfort.

Similarly, an alternate embodiment of the mattress 13 of the present invention is shown which involves a foam core 61 and a fill material 59. While only a central core portion 61 is shown in the preferred embodiment described herein, various layers of foam and pile can constitute the interior 47 of mattress 13, as desired. A lower flange 64 has one end portion 113 anchored within the foam core 61 by anchoring means 44 and the opposite end of the flange 64, designated by reference numeral 111, is anchored by the tape strip 42 as hereinafter described. The flange 64 is pulled tightly up (or down) to hold or secure the mattress together as previously described with reference to the spring embodiment referred to above.

FIG. 3 also shows that the outer peripheral edge portion 114 of the top deck cover 15' is sewn to an interior, folded over and presewn end portion of the ribbon 81 and simultaneously to the end portion 79 of the zipper strip 71 to anchor the end 79 of the zipper strip 71 to the previously folded and pre-stitched end portion of the ribbon 81 and to the upper deck cover 15' together, as by conventional stitches or the like. The opposite end 81 of zipper strip 71 includes the zipper portion 21. The upper end portion 106 of the flange 63 is then positioned under the outer peripheral end portion 114 of the deck cover 15', which is, in turn, positioned below the outer end portion 77 of the ribbon 81. The peripheral end portions 77 and 114 of the ribbon 81 and the deck cover 15' are initially stitched together and then the stitched combination of the portions 77 and 114 are sewn to the outer peripheral end 106 of the flange 63 by conventional stitches or the like. Lastly, the upper end portion 107 of the side covering of the side panels 14 is disposed adjacent the outer peripheral end portion of the flange 63. The entire group of end portions 77, 114, 106 and 107 of the ribbon 81, deck cover 15', flange 63, and side panel covering 23, respectively, are then sewn together and bound within a closing member or tape edge 41.

Similarly, the bottom of the mattress 13 includes a lower deck cover 16 having an outer end portion 115. A ribbon member 68 has one end 82 folded back on itself and stitched together. A zipper strip 72 has one end 80 placed or disposed over the folded end 82 of the ribbon 68, and both are simultaneously attached to deck cover 16, as by conventional stitches or the like, through the folded over end portion 82 thereof. The opposite end 76 of the zipper strip 72 terminates in the zipper portion 22 which forms one half of the zipper combination represented by reference numeral 24 of FIG. 1. The opposite end portion 77 of the ribbon member 68 is then attached to the end portion 115 of the lower deck cover 16, as by conventional stitching means. The attached combination of the peripheral end portions 77 and 115 of the ribbon 68 and deck cover 16, respectively, are then fixedly secured to the outer end portion 111 of the lower flange 64, as by conventional stitches or the like. The lower end portion 108 of the side covering 23, which comprises the side covering material 109 and the corresponding upper and lower end portions 107 and 108, respectively, is then disposed adjacent the opposite or unattached end portion 111 of the flange 64 and the four end portions 108, 111, 115, and 77 of the side covering 109, flange 64, deck covering 16 and ribbon 68, respectively, are then placed within closing member or tape 42 which is then fixedly attached thereto for sandwiching the outer end portions together, as by conventional stitches or the like. It will be noted that the attachment method of the top of the mattress 13 of FIG. 3 is different than that shown in FIG. 4, as hereinafter described.

Figure 4:
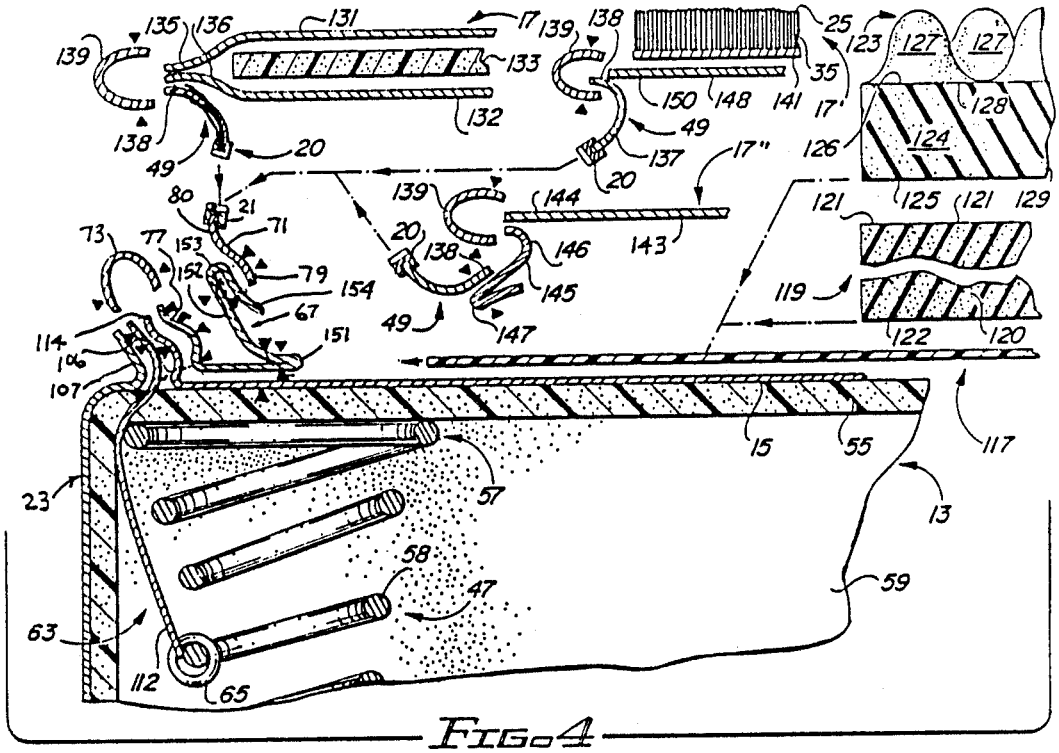
FIG. 4 is a sectional side view, partially exploded and exaggerated, illustrated in greater detail to various fastening means, removable mattress covers and intermediate layers of the present invention.

FIG. 4 illustrates various embodiments of the upper or top removable mattress cover 17, various intermediate members and various methods of removably attaching the removable mattress cover 17 to the upper deck 15 of the mattress 13. In FIG. 4 the upper or top removable mattress pad or removable mattress cover 17 is shown as including an outer layer 131, which includes any of a number of materials, as hereinafter described. The primary requirements of the layer 131 is that it be aesthetically pleasing to the eye and pleasant to the touch or "feel" for the comfort of the person lying on the sleeping surface 10 thereof since it is this exterior surface 131 of mattress cover 17 which, in fact, forms the integral sleeping surface of mattress 13.

In the preferred embodiment, the upper removable mattress cover 17 also includes a lower or interior layer 132 of a suitable fabric material and, sandwiched therebetween, a cushioning means such as a foam pad or sheet 133, or simply a fill material. The end portions 135, and 136 of the upper and lower surface materials 131 and 132 of the removable mattress cover 17 can be sewn together or positioned together and disposed adjacent one end portion 138 of a zipper strip 49 whose opposite end is connected to one zipper portion 20 of the zipper member or assembly 19 of FIG. 1. The end portions 135, 136 and 138 of the upper layer 131, lower layer 132, and zipper strip 49 are positioned within a U-shaped closing portion or tape edge 139 and secured, sandwiched therein, as by conventional stitching or the like.

In an alternate embodiment, the upper or top removable mattress cover 17' includes a sheepskin portion 35 having an outer fur or nap surface 25 and an interior base 141 which may be the sheepskin itself or any type of material means to which the wool can be attached. Sheet 148 represents the lower covering or surface of the removable mattress cover 17', and the end portion 150 of the lower material 148 can be stitched to the end portion of the sheepskin composite 35 and then disposed adjacent the end portion 138 of the zipper strip 49 whose opposite end 137 is connected to the zipper portion 20. The end portions of the sheepskin 35 and the end portions 150 of the lower covering 148 can be disposed adjacent the end portion 138 of the zipper strip 49 and all can be inserted within the bight of a hollow U-shaped portion of the tape member 139 and fixedly secured therein as by stitches or the like.

FIG. 4 also shows an embodiment wherein the upper or top removable mattress cover 17'' is represented by a single sheet of material 143 which has one end portion 144 attached to the end portion 146 of the ribbon 145 by conventional stitching or the like. The opposite end 147 of the ribbon 145 is doubled back upon itself and sewn together, and then the sewn end portion 147 is sewn or otherwise fixedly attached to one end 138 of the zipper strip 49 whose opposite end terminates in the zipper portion 20, as previously described. In this embodiment of FIG. 4, the end 138 of the zipper strip 49 is attached to the folded and sewn end 147 of the ribbon 145 rather than being sewn simultaneously to the deck 15. The opposite end 146 of the ribbon 145 together with the end portion 144 of sheet 143 are inserted within the bight of the U-shaped portion 139 and fixedly secured therebetween as by stitching or the like.

Figure 8:
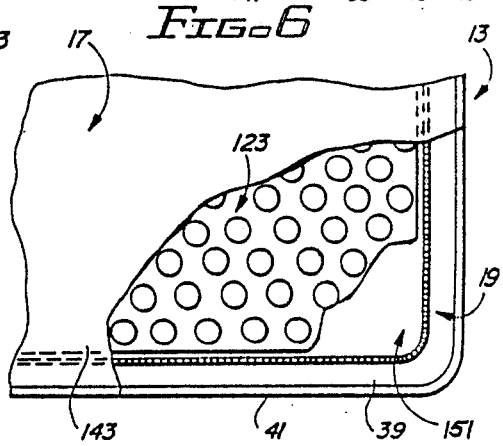
FIG. 8 shows still another plan view, partially broken away, illustrating still another embodiment of the improved mattress of the present invention.

FIG. 4 also shows that various intermediate layers can be disposed between the exterior surface 132 of the removable mattress cover 17. The internal layers or inner panels may be any one or more of the layers or materials hereinafter described, including a sheet of waterproof material 117 which may be either used in place of the deck cover 15 and as a substitute therefore such that it is fixedly secured to the outer peripheral top surface of the mattress 13 as illustrated in FIG. 8. When it is used along with and as an addition to the deck cover 15, rather than as a substitute therefore, it may be fixedly secured to the outer peripheral edge portions thereof by stitching or the like or simply laid loosely thereover so that it can be removed when the top mattress cover 17 is removed from the mattress 13. Furthermore, a layer or pad 119 of foam material 120 having a substantially flat top surface 121 and a substantially flat lower surface 122 can be disposed over the deck pad 15 or, more preferably, over a waterproof deck pad 15'. Alternatively, a first intermediate layer, can be such as the waterproof sheet 117 and positioned over the deck pad 15 and under the top removable mattress cover 17 when it is attached to the deck cover 15. The removable mattress cover 17 can be unzipped and removed or partially removed to permit the removal of the foam sheet 119 for cleaning and the like.

Furthermore, the intermediate layer(s) may include a special purpose foam pad 123 which includes a generally rectangular and substantially flat base 124 having an upper surface 126 and a lower surface 125. The upper surface or portion 126 of the assembly 123 includes a plurality of generally egg-shaped or ovoid-shaped or rounded mounds convolutions, or protrusions 127 of foam material which have their base 128 fixedly secured to or integrally formed as a part of the upper surface 126 of base portion 124. The lower edge portion 129 of the base 124 is adapted to be disposed over a waterproof sheet 117 or waterproof deck covering 15' such that the water, liquid or moisture passing through the removable mattress cover 17 is absorbed and temporarily stored by the foam material of the base 124 and particularly collected and stored in the lower edge portion 129 adjacent the waterproof sheet 117 or 15', since the waterproof sheet 117 or waterproof pad 15' prevents the passage of any liquid or moisture therethrough and therefore prevent it from entering the interior 47 of the mattress 13. Further, the foamed pad 123 with its protrusions 127 can be used to impart a high quality "feel", as well as a "look" to the combination 11 of the present invention. The special purpose assembly 123, with its protrusions 127 and base 124, also serves to provide additional comfort and support to the person occupying the top sleeping surface 10 of the mattress 13 due to its resiliency, as well as serving to functionally, spacially separate the person from the liquid or moisture absorbed and retained by the lower portion 129 of the foam base pad 124 to prevent the person from feeling wet or uncomfortable much the same as modern baby diapers functions.

Lastly, the details of the fastening means and top portion of the interior 47 of the mattress 13 will be described with reference to FIG. 4. In FIG. 4, the outer peripheral portion of the interior 47 is provided with the upholstery pad 15 or layer of foam material 55 and spring members 57 are positioned between the upper and lower upholstery portions 55, as conventionally known. Various fill materials 59 can be placed in and around the springs 57 in various stacked relationships, or loose, with or without foam material to provide additional resiliency, support and comfort to the mattress 13 of the present invention. An intermediate spring coil 58 has anchored thereto the opposite end 112 of the flange 63 which is secured or attached to the coil 58 as by a loop, ring, or hog-ring member 65. The flange 63 is pulled snugly upward before (or downward after) the upper end 106 is secured for basically pulling or holding the mattress assembly together.

The top of the upholstery layer 55 is outwardly bounded by the upper deck cover 15, not the sleeping surface 10 of the mattress 13, and the side cover 109 of the side material 23 of side panels 14. FIG. 4 shows a ribbon 67 having an intermediate portion 151 folded back upon itself with the upper and lower folds attached together, as by sewing and the like, while the sewn fold 151 is also secured to the deck cover 15 as by conventional stitching means. The ribbon 67 then extends, as indicated by reference numeral 152, to a second folded portion 153 which terminates in an end portion 154. The end portion 154 is fixedly attached to the end portion 79 of the zipper strip 71, as by conventional stitching, and the combination of the attached ends 154 and 79 of the ribbon 67 and zipper strip 71, respectively, are then secured to one another through the folded portion 153 as by conventional sewing techniques. The opposite end portion 80 of the zipper strip 71 terminates in the zipper portion 21 of the upper zipper assembly 19 of FIG. 1, as previously described. Furthermore, the opposite end portion 77 of the ribbon 67 is disposed adjacent an opposite end portion 114 of the deck cover 15 and connected together as by stitches or the like. This sewn together portion is then positioned adjacent the end portion 106 of the flange 63, and the combination of the end portion 106 of the flange 63, and the already-connected end portions 114 and 77 of the deck cover 15 and ribbon 67, respectively, are fixedly secured by one or more conventional sewing means. Lastly, the outer end portion 107 of the side covering 23 is disposed against the end portions 77, 114, 106 and 107 of the ribbon 67, deck cover 15, flange 63 and side panel material 23, and then this combination is inserted into the bight of a U-shaped tape member 73 and fixedly sandwiched and sewn therein as by conventional sewing techniques.

It will be observed that the attachment method of FIG. 4, as described herein, is different then the attachment method described with reference to FIG. 3. In this embodiment, the end 79 of the zipper strip 71 is first attached to one end portion 154 of the ribbon 67 and then the ribbon 67 but not the zipper strip 71 is attached to the deck cover 15, whereas in the embodiment of FIG. 3, the folded and sewn end portion of the ribbon is disposed against the lower end 79 of the zipper strip 71 and both are simultaneosly sewn to the deck cover 15'. It will also be understood that various other attachment methods, sewing methods, and types of attachments can be made without affecting the scope and content of the present invention.

Figure 5:
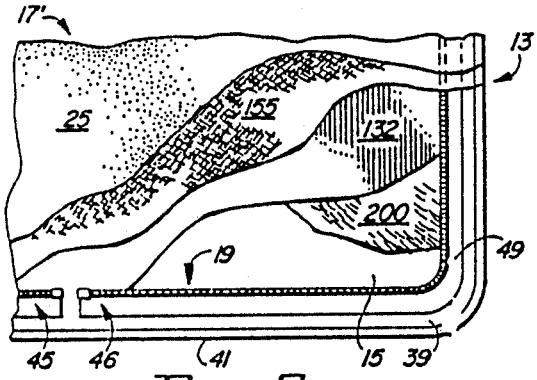
FIG. 5 is a partial top plan view, partially broken away, of a mattress pad-mattress combination including a fabric deck cover, an intermediate layer and a sheepskin cover.

FIG. 5 shows a cut-away view of a top portion of the mattress 13 and removable top cover 17' combination of the present invention. In FIG. 5, it will be seen that the removable mattress cover 17' is so designated since it represents the sheepskin embodiment previously described, and the exterior or top sleeping surface is shown as being upon the upper surface of the sheepskin wool or nap portion 25. Immediately beneath the sheepskin portion 25 is shown a generalized intermediate layer 155 which can be made of various materials, as hereinafter described. The lower or bottom layer 132 of the removble cover 17' is then shown so that the intermediate material 155 is sandwiched or disposed between the lower or interior surface material 132 and the upper or outer layer of sheepskin material 25 having an outer furry sleeping surface, as presently shown. The removable cover 17', and more specifically the lower or interior surface 132 thereof, is then disposed over and the outer peripheral edges thereof are attached to the deck cover 15 as by the zipper 19. The zipper 19, as shown in FIG. 1, actually represents two separate and distinct zipper assemblies 45 and 46 which can be zipped and unzipped one half the way around the peripheral edge of the mattress for removing and attaching the removable mattress cover 17'. Layer 200 generally represents a waterproof sheet of material, a sheet or pad of foam material, or some similar insulator or comfort-increasing material which is placed between the upper surface of the top deck cover 15 and the undersurface or interior surface of the interior covering material 132. Alternatively, reference numeral 200 can be used to represent a large heating pad or electric blanket removably disposed therebetween. Lastly, FIG. 5 shows the zipper 19 as being secured through a zipper strip 49 and a ribbon 39 which terminate in the outer tape edge 41.

Figure 6:
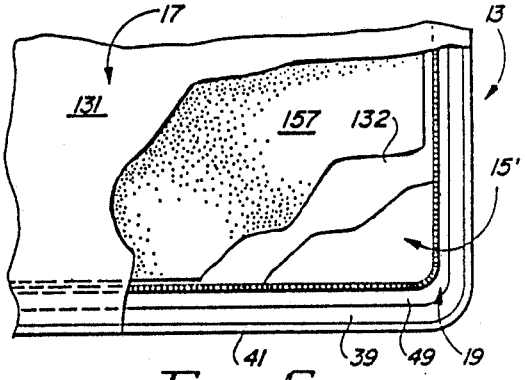
FIG. 6 is similarly a partial top plan view, partially broken away, of the improved mattress of the present invention showing a waterproof deck cover, intermediate foam layer, and removable mattress cover.

FIG. 6 shows a similar cut-away view to that of FIG. 5 wherein the upper or top surface of the removable mattress cover 17 includes a first exterior layer of material 131 forming the sleeping surface and the lower or bottom surface of the removable mattress cover 17 includes a second or bottom layer of material 132. Sandwiched therebetween may be any conventional fill and/or foam material 157 or any similar natural or synthetic material, fabric, or fiber means for insulation or comfort, as known in the art. The fill and/or foam means of FIG. 6 is designated by reference numeral 157, and the bottom surface 132 of the removable mattress cover 17 is seen as overlying and being removably attached to and detached from the deck cover 15' of the mattress 13 by the zipper 19. The deck pad or deck cover 15' is shown in FIG. 6 as including a sheet of waterproof material such as vinyl plastic, any other suitable plastic material, a rubber material or the like which is impervious to the passage of moisture or liquid therethrough for preventing any liquid or moisture from passing through the removable mattress cover 17 from reaching the interior of the mattress 13 and soiling or otherwise damaging same. Similarly, the outer edge portion is shown as including a zipper strip 49, a ribbon 39 and an tape edge 41 as previously described.

Figure 7:
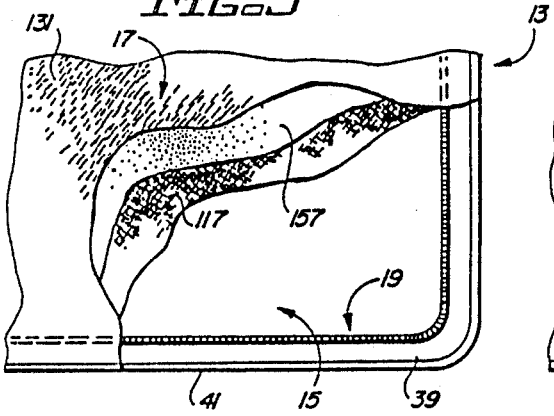
FIG. 7 similarly shows the plan view, partially broken away, of another embodiment of the improved mattress of the present invention.

FIG. 7 represents still another cut-away view similar to those of FIGS. 5 and 6 and illustrates that the top removable mattress cover 17 may include a top or outer sheet of fabric material 131 and usually includes an intermediate and bottom layer (not shown in FIG. 7) but which may or may not be included. Positioned beneath the removable mattress cover 17 is shown a sheet of waterproof material 117 operably disposed or placed over the waterproof sheet 117 and under the lower surface of the removable mattress cover 17. The waterproof material 117 may be, as previously described, a sheet of vinyl plastic or any otherwise suitable material which is impervious to the passage of water, moisture and liquid therethrough, with the sheet 117 being simply disposed upon the upper surface of the deck cover 15 and the foam pad or similar fill means 157 being operably and removably disposed upon the removable waterproof sheet 117. The removable mattress cover 17 then holds or positions the foam pad 157 and waterproof sheet 117 between its lower surface 132 (not shown in FIG. 7) and the upper surface of the deck cover 15.

Lastly, FIG. 8 shows still another cut-away view similar to those of FIGS. 5, 6 and 7 and illustrates the removable mattress cover 17 as having a top surface 143; the deck cover 15' as being a non-removable sheet of waterproof material 151 and an intermediate, specialty foam or fill assembly 123 positioned between the upper surface of the waterproof deck cover 151 and the lower or inner surface (not shown) of the removable top mattress cover 17.

In the preferred embodiment of the present invention, it will be understood that the material of the various ribbon members normally matches the side mattress cover fabric 23 disposed about the side panels 14 of the mattress 13. The flanges 63 and 64 are themselves made preferably of a non-woven synthetic material such as a polyester fabric manufactured under the trade name "Bondex"# manufactured by the Haynes Converting Company of Conover, NC, although any similar suitable materials can also be used. The deck covers 15 and 16 are conventionally manufactured with a similar non-woven synthetic material, such as manufactured under the trade name "Tietex" TM which is a product of the Tietex Company of Spartenburg, SC, although any similar suitable material could also be used for the deck covers 15 and 16. Likewise, the deck covers may preferably be a sheet of waterproof material such a vinyl plastic, rubber material or any type of synthetic or natural material or fabric which is impervious to the passage of liquid or moisture therethrough. These are particularly useful in cases where the mattress-removable mattress cover combinations of the present invention are used in some hospitals, nursing homes, and other institutions or the like having incontinent patents or those which tend to wet or otherwise soil the beds frequently and in which all beds are not entirely covered with waterproof means already.

The interior 47 of the mattress 13 is normally provided with stacked layers of foam-type material and/or various fill materials; and the mattress 13 generally includes the deck covers 15 and 16, the upholstery layers of foam material 55, insulating layers of coarse material or fill material such as coconut fibers, sisal, or the like. The interior core unit which may include a solid or layered foam core, inner springs, fill materials, or any similar means utilized in conventional mattresses for providing resiliency, firmness, and comfort therein. The various materials used for the upholstery 55, the intermediate foam layers 155, the foam cores 61 and the like generally include high resilience, natural or synthetic foam materials such as polyurethane, urethane foam, polyfoam, or any similar foam-like product, in addition to or as a substitute for various fill materials or layers of fill materials and foam materials as desired.

It will also be understood, that while various conventional stitching or sewing means were recited herein, that all conventional sewing techniques including sideways stitches, edge stitches, overlapping stitches, double stitches, and all other types of stitches are included within the scope of the present invention and the terminology used herein as required to meet the needs of the particular sewing operations.

The removable mattress pad combination of the present invention will find particular use in establishments such as hotels, motels, dormitories, barracks, some hospitals, some nursing homes, boarding schools, furnished apartments, and similar institutions, organizations and establishments which have a relatively high turnover of persons using the mattresses (and which do not use special all waterproof-washable covers already). Since the mattresses of the prior could often have the sleeping surface marred or otherwise rendered unusable by unsightly stains, odors, dirt, grime and the like, the usual solution in the prior art was to flip the mattress once until the opposite side acquire similar stains etc. and then throw the mattress out, since cleaning was virtually impossible by any conventional method of reasonable cost. With the combination of the present invention, the removable top mattress cover 17 can be removed from the mattress 13 for washing, laundering, or cleaning regardless of the type of stain, dirt, grime or unsightly blemishes or odors thereon and a similarly constructed removable mattress cover can be substituted or interchanges therefore. In the preferred embodiment, the mattress and removable cover combination includes both an upper and a lower removable mattress cover so that when the upper mattress cover is removed for cleaning, it can be replaced or interchanged with the lower mattress cover so that the mattress can be continually ready for use even during the laundering operation. Furthermore, even if the top removable mattress cover becomes ripped or torn, it can be replaced relatively inexpensively and another removable mattress cover simply substituted therefore to make the mattress as good as new, at least when compared to costs of replacing the entire mattress 13.

It will be understood that various types of fill material, foam material or the like can be included between the upper and lower surfaces of the removable mattress covers of the present invention including such things as fill material, foam material, or even goosedown, eider down, or the like to provide an old-fashioned comforter-type sleeping surface. The upper surface 131 of the removable mattress cover 17 may include any aesthetically pleasing material in any pattern, decoration, color or the like including at least such materials as cotton, satin, felt, velvet, silk, real or artificial animal fur, and other real or natural fibers or synthetic materials known in the art. Primarily, the removable cover materials will be chosen on the basis of their aesthetic appeal and their "feel", texture, or their comfort. Of course, the materials can and will also be chosen on the basis of function for particular applications as in hospitals, nursing homes, and the like, as previously described hereinabove.

Furthermore, in the preferred embodiment of the present invention, at least the top deck cover 15 may include a sheet of waterproof material while the opposite or bottom deck cover is a standard fabric material or a second sheet of waterproof material, as desired. Yet further, in the preferred embodiment of the present invention, the top removable mattress cover and bottom removable mattress cover may be identical or may be different and distinct; or additional substitute removable mattress covers can be provided such that each is different and distinct from one another and yet totally interchangeable with both the upper and lower removable mattress cover so that they can be interchanged at will with one another such as with the change of seasons of the year or when different age or temperament individuals are occupying the bed or the like. For example, when a child is occupying the bed, the removable mattress cover may include a bright colored pattern of clowns or children's designs; and when the child leaves and an elderly person takes his or her place, the removable mattress cover can be changed to one having a more peaceful and sedate appearances or the like.

Lastly, another embodiment of the present invention contemplates the use of a heating pad 200 as shown in FIG. 5. The heating pad 200 may include a zipper about the outer periphery thereof so that it also can be used as or substituted for a removable mattress cover for providing heat beneath the person lying on the surface of the bed to warm the bed more efficiently rather than by providing the heat from above as with conventional electrical blankets and the like. Alternatively, the heating pad 200 may be devoid of a zipper or fastening means and may be simply laid over or sandwiched between the upper surface of the deck cover 15 and the lower surface of the removable mattress cover 17 so it can be selectively added to or removed from the combination, as desired by the occupant of the bed. Furthermore, it will be understood that the outer surface of the heating pad can include a decorative-type material adapted to match the material 23 of the sides 14 of the mattress 13 to further facilitate the use of the heating pad as a zip-on or readily attachable/detachable removable mattress cover unit.

It will be understood by those or ordinary skill in the art, that various modifications, substitutions, alternatives, variations, and changes in the constructions, materials, and assembly techniques of the present invention can be used, without departing from the spirit and scope of the present invention, which is limited only by the appended claims.

I claim:

1. An improved mattress arrangement comprising:

a mattress body;

at least one deck cover means permanently attached around a perimeter portion of said deck cover means to at least one surface of said mattress body for providing an integral surface therefor, said deck cover means having exterior extension portion means located around the perimeter portion of said deck cover means for providing a cavity region above said deck cover means;

at least one removable mattress cover means for providing a sleeping surface, said removable mattress cover means being removably attached to said exterior extension portion means to enclose said cavity region when attached to said exterior extension portion means;

removable and interchangeable solid type fill means positioned in said cavity between said at least one deck cover means and said at least one mattress cover means for providing different thicknesses of said solid type fill means to provide variable levels of comfort and support depending upon the thickness, density, content and flexibilty of the material used for said fill means; and coupling means for detachably coupling said at least one mattress cover means to said at least one deck cover means to enclose said fill means.

Please accordingly number of other claims now on file and correct their claim dependencies.

2. An improved mattress arrangement in accordance with claim 1 further comprising:

said at least one deck cover means comprising two deck cover means coupled to opposing surfaces of said mattress body for providing two integral surfaces with said mattress body; and said at least one removable mattress cover means comprising two interchangeable and removable mattress cover means for providing sleeping surfaces on each side of said mattress body.

3. An improved mattress arrangement in accordance with claim 2 wherein a first of said two interchangeable cover means has an outer surface composed of a woven fabric and a second of said two interchangeable cover means has an outer surface composed of a group of fur-type material comprising animal fur and synthetic fur materials.

4. An improved mattress arrangement in accordance with claim 2 wherein a first of said two deck cover means is composed of a woven fabric and a second of said two deck cover means is composed of a waterproof material.

5. An improved mattress arrangement in accordance with claim 1 wherein said deck cover means is composed of a woven fabric material.

6. An improved mattress arrangement in accordance with claim 1 wherein said deck cover means is composed of a waterproof material.

7. An improved mattress arrangement in accordance with claim 1 wherein said mattress cover means has an outer surface composed of a woven fabric.

8. An improved mattress arrangement in accordance with claim 1 wherein said mattress cover means has an outer surface composed of a group of fur-type material comprising animal fur and synthetic fur materials.

9. An improved mattress arrangement in accordance with claim 1 wherein said removable and interchangeable fill means comprises a group of resilient foam materials.

10. An improved mattress arrangement in accordance with claim 1 wherein said removable and interchangeable fill means comprises a group of woven pad-type materials.

11. An improved mattress arrangement in accordance with claim 1 wherein said removable and interchangeable fill means comprises a group of solid materials.

12. An improved mattress arrangement in accordance with claim 1 wherein said removable and interchangeable fill means comprises a combination of two or more of the groups of resilient foam materials, woven pad-type materials, and solid materials.

13. An improved mattress arrangement in accordance with claim 1 wherein said coupling means comprises a zipper-type fastener.

* * * * *

UNITED STATES PATENT AND TRADEMARK OFFICE

CERTIFICATE OF CORRECTION

PATENT NO. : 4,809,375

DATED : Mar. 7, 1989

INVENTOR(S) : Barry J. Bull

It is certified that error appears in the above-identified patent and that said Letters Patent is hereby corrected as shown below:

In Column 16, Claim 1, Line 36, please delete the phrase "Please accordingly number of other claims now on file and correct their claim dependencies."

Signed and Sealed this

Third Day of October, 1989

*Attest:*

DONALD J. QUIGG

*Attesting Officer*

*Commissioner of Patents and Trademarks*